US006070872A

United States Patent [19]

Squitieri

[11] Patent Number: 6,070,872

[45] Date of Patent: Jun. 6, 2000

[54] CASINO GAME OF CHANCE DEVICE AND METHOD

[76] Inventor: Gene Squitieri, 650 Tam O'Shanter, Las Vegas, Nev. 89109

[21] Appl. No.: 09/033,284

[22] Filed: Mar. 2, 1998

Related U.S. Application Data

[63] Continuation-in-part of application No. 08/743,633, Nov. 4, 1996, abandoned.

[51] Int. Cl.[7] ..... A63F 1/00

[52] U.S. Cl. ..... 273/292; 273/274

[58] Field of Search ..... 273/274, 309, 273/292, 146, 268

[56] References Cited

U.S. PATENT DOCUMENTS 4,421,315 12/1983 Cutler .
4,443,012 4/1984 Makovic et al. .
5,118,114 6/1992 Tucci .
5,257,789 11/1993 LeVasseur .
5,560,613 10/1996 Nguyen .

*Primary Examiner*—William M. Pierce
*Attorney, Agent, or Firm*—Thorpe, North & Western

[57] ABSTRACT

A method for playing a game of chance including providing a playing surface with various betting areas defined thereon. The game proceeds through three distinct phases, where different game activities take place and during which individual bets can be made and are paid at the end of each phase. The three game phases each focus on a different gaming area of the playing surface. The first game phase involves wagering on a roll of a die to determine which two of the three face-down cards will be turned face up. The second phase of the game includes a wide range of high, moderate and low risk wagers with corresponding payouts. Wagers can be made as to expected sum of the two cards, or whether the sum is odd, even, or above or below certain values. The third phase of the game is focused back on the value of the last unturned card.

19 Claims, 6 Drawing Sheets

CASINO GAME OF CHANCE DEVICE AND METHOD

This application is a CIP of application Ser. No. 08/743,633, filed Nov. 4, 1996, now abandoned.

BACKGROUND OF THE INVENTION

1. Field of the Invention

This invention pertains to a game of chance and, more particularly, to a method of playing a game used in a casino wherein the players make bets to win money based on rolling a die and using playing cards to obtain winning combinations which will result in a payout to those players who overcome the odds, wherein the player who overcomes the greatest odds on winning bets will receive substantially large payouts.

2. State of the art

There are numerous casino betting games which call for players to make bets and win money based on the odds which they overcome to win. Typically, these games focus on a particular device and method. For example, roulette is a game in which a player places a bet on a colored and numbered mark representative of a corresponding mark on a wheel. A ball is rolled which eventually falls into a slot with a mark. If the player has selected the mark in which the ball fell, the player wins. Rating this game by skill level teaches a player that virtually no skill is required. The players must blindly place bets and watch the ball roll. There is little opportunity for varying the odds against which the player must play. There is also only a single phase of game play. Betting occurs, a ball is rolled and lands in a slot, and the play is over.

A different well-known casino game of chance which uses a different device and method is blackjack or twenty-one as it is also known. Blackjack is a game which only uses playing cards. A player learns that unlike roulette, blackjack does require a certain amount of skill in an attempt to beat the odds to win against the house.

One other well-known casino game of chance which is worth mentioning is craps. Craps uses another different device, a pair of dice, which are rolled in an attempt to obtain certain advantageous combinations of rolls. The player must attempt to get certain combinations of rolls and the beat the odds against rolling them to win.

The aforementioned casino games of chance are related in that they all require a player to beat the odds to win. They also require a player to use widely varying degrees of skill. If skill level were the only factor in determining a good game of chance, the popularity of many successful games of chance would be unexplainable. However, some other factors which must be considered are the pace of the game, ease of play, attractiveness of layout, the involvement of the players, the number of players, the playing devices used in the game, and the strategy which a player can use in the game.

When approaching a new casino game of chance, a player is likely to consider all of the factors above when deciding whether to play. However, another factor affecting a player's decision is the degree of familiarity. In other words, if the game is too different, even if uncomplicated, a player may decide to move on to something that is either well-known, or at least not too far removed in method of play from other games.

Therefore, it would be an advantage to create a casino game of chance which uses familiar playing devices and similar methodology of play, yet still provides a new game structure which will pique players' curiosity and keep them at the table once they have begun to play.

OBJECTS AND SUMMARY OF THE INVENTION

It is an object of the present invention to provide a new method for using familiar gambling devices for playing a new game of chance.

It is another object to provide such a method for playing a game of chance wherein in a single turn, players are given at least three opportunities to place bets.

It is still another object to provide a method for playing a game of chance in which up to twelve players can play simultaneously.

Yet another object is to provide a game of chance which features an attractive game layout.

Still another feature is to provide a game of chance which uses a combination of playing cards and a die to play the game.

Still yet another object is to provide a game of chance which provides a range of betting opportunities to please players who prefer a small risk, while also providing potentially large payouts, all depending upon player preference.

The above and other objects of the invention are realized in specific illustrated embodiments of a method for playing a game of chance including providing a playing surface with various betting areas defined thereon. The game proceeds through three distinct phases, where different game activities take place and during which individual bets can be made and are paid at the end of each phase.

The three game phases each focus on a different gaming area of the playing surface. The first game phase includes using a center game area which provides a place for laying cards face down on the playing surface. The first game phase also uses a die which is rolled to determine which two of the three cards will be turned over. Before the die is rolled, bets are placed on which of the cards will be turned. This phase of the game has a low risk and consequently low payout.

The second phase of the game includes a wide range of high, moderate and low risk bets with corresponding payouts. Regarding the two cards to be turned over as defined by the roll of the die in the first phase, bets can be made as to the expected sum of the two face-down cards which are turned over, or whether the sum is odd, even, or above or below certain values. When all bets are made, the two cards are turned and winning bets are paid while losing bets are collected.

The third phase of the game is focused back at the center game area where a final bet can be made as to the value of the last unturned card. However, there are actually two wagering strategies which can be effected. A first is a no-strategy play The second is a most probable outcome. The degree of risk in this phase is moderate to low.

In accordance with one aspect of the invention, a player can choose to make bets in one, two or all three phases of the game. This can enable the player to make bets having a variety of high, moderate and/or low risk.

In accordance with another aspect of the invention, a two card total of eleven in the second phase of the game provides no payout and all bets are automatically losing bets. The player must keep in mind that the odds are greatest that the two card total will be a sum equal to eleven, hence the name of the game is "(NO ELEVEN)."

In accordance with still another aspect of the invention, the deck used in (NO ELEVEN) consists of only twenty cards. After the three phases of the game are played, the entire deck is reshuffled with the three cards which were on the playing surface. The relatively fast pace of the game is maintained because it is of no benefit to the player to try and remember which cards were used in previous rounds because each round begins with a freshly shuffled deck.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the pending claims.

Figure 1:
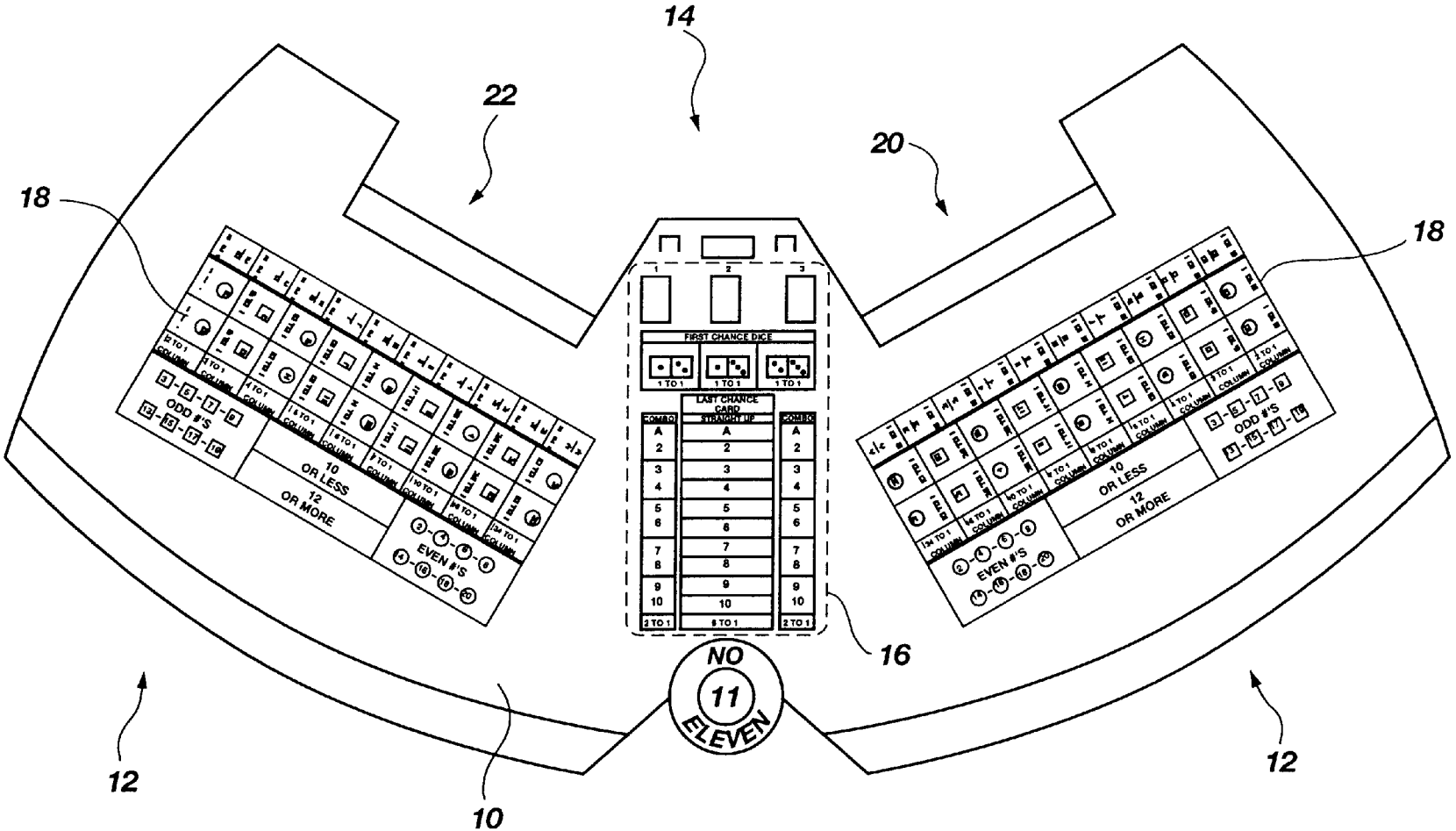
FIG. 1 is a top view of the complete board layout for a game of chance made in accordance with the principles of the present invention.

FIG. 1 shows a plan view of the game surface 10 for (NO ELEVEN). The game surface 10 will typically be placed on a table (not shown) with players standing or sitting at a player's side 12, and a dealer or dealers standing behind the table at a dealer's side 14. It should be apparent from the design of the game surface 10 that there is a unique center game area 16 used for the first 24 and third 26 phases of a betting round. The center game area 16 divides two identical second phase game areas 18. The dealers's side 14 is shown with what appear to be two stations 20, 22 so that a single dealer can reach the second phase game areas 18 easier, or two dealers can work simultaneously to collect losing bets and pay off the winning bets to thereby maintain a rapid game pace.

FIG. 1 shows that the second phase game areas 18 are identical so that more players can participate simultaneously without having to crowd to try and reach the center of the game surface 10. As a practical matter, experimentation has shown that 6 players playing on a single second phase game area 18 is optimal for the actual dimensions of the game area 18 shown.

The second phase game area 18 is appropriately emphasized by being duplicated on the game surface 10 because it is here that the widest range of odds can be bet against. Consequently, it is the game area which is typically used by the players the most. It will be shown that a player betting at the second phase game area 18 can still bet at the same or nearly the same odds which occur at the center game area 16, but may also take much greater risks to obtain correspondingly larger payoffs.

Figure 2:
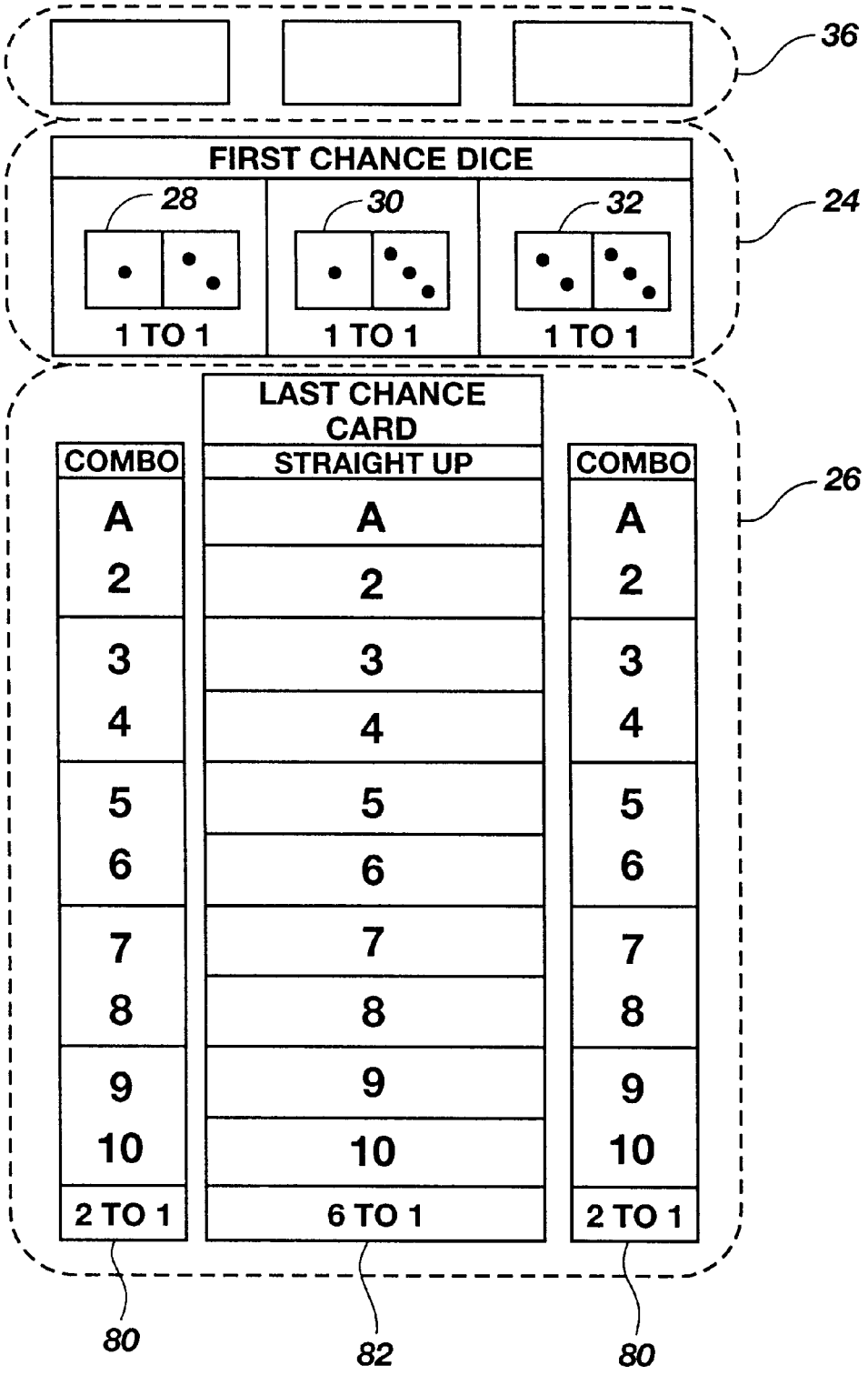
FIG. 2 is an enlarged top view of the center game area of the board in FIG. 1 showing detail of where the playing cards are placed, the betting area of the first phase, and the betting area for the third phase of the game.
Figure 3:
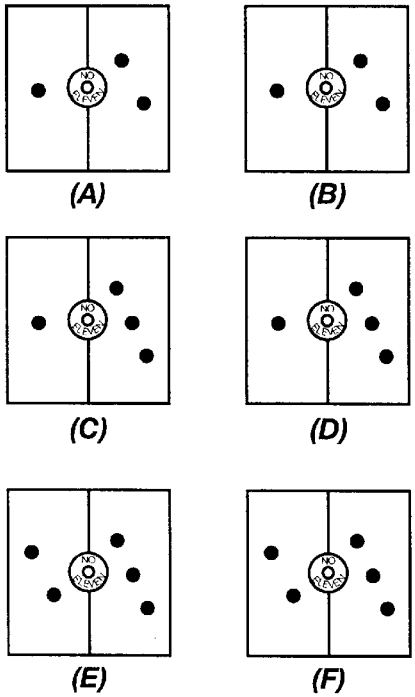
FIGS. 3A to 3E show six top views of the faces of a die used in the game (NO ELEVEN).

FIG. 2 is an enlargement of the betting area of the first 24 and third 26 phase game areas in the center game area 16. The first phase game area 24 is comprised of three areas 28, 30 and 32. These areas define the three possible rolls on the 6 sided (NO ELEVEN) die 34 shown in FIG. 3. Each side of the die 34 is segmented so as to be divided into two separate halves, each segment having a number displayed thereon. Only three cards are dealt onto the table as will be explained later. The numbers in each of the segments correspond to the numerical designation or position of the cards, not the value of the cards themselves. Therefore, each side of the die 34 can have one of three possible number combinations. The possible number combinations are (1 and 2), (1 and 3) and (2 and 3). Obviously, if the die 34 is six sided and there are three possible number combinations or groupings, then each of the number groupings is repeated once on die 34. In a preferred embodiment, each like number grouping appears on opposite faces of the die 34. Other possible uses of the die will be explained more fully later.

Figure 4A:
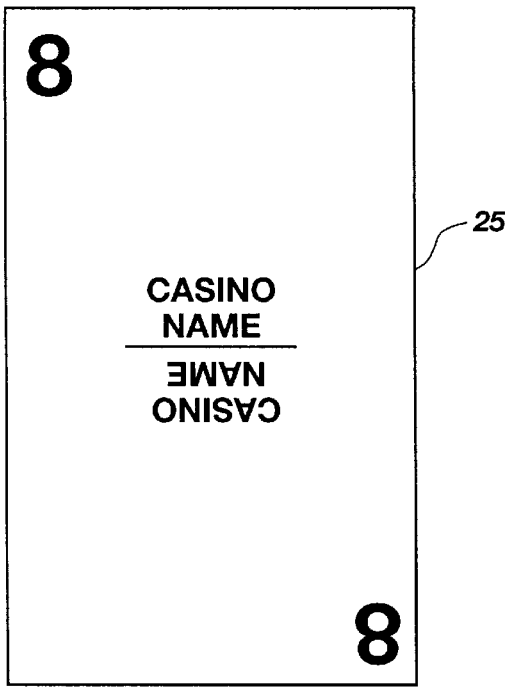
FIGS. 4A and 4B are the face and bottom view of a typical card in a (NO ELEVEN) deck of cards.
Figure 4B:
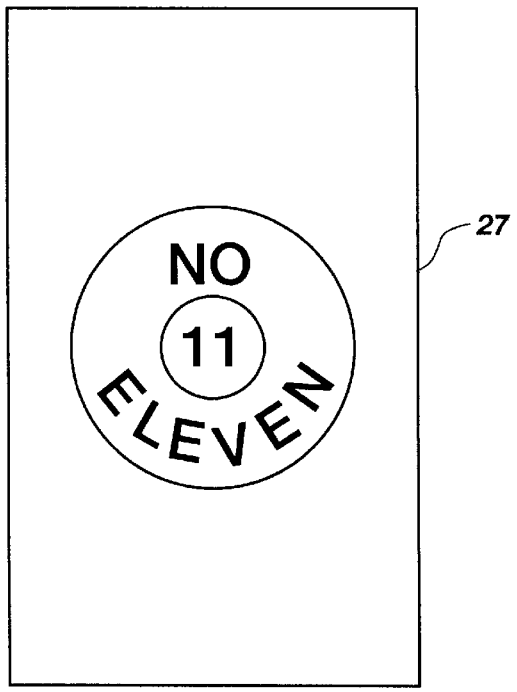

Before game play can commence, the following preparations are made. In a preferred embodiment, there are typically two dealers working at the game table 10. Each of the dealers has their own deck of twenty custom (NO ELEVEN) cards. Both dealers shuffle their decks, although only one deck is used at a time. The card values are comprised of two sequences of Ace, 2, 3, 4, 5, 6, 7, 8, 9 and 10, for a total of twenty cards. A sample of the face and back of a card is shown in FIGS. 4A and 4B. FIG. 4B shows a numbered face 25 of a card, while FIG. 4B shows the back 27. A final preparation is to give chips (not shown) to the players. Keeping track of which chips belong to which player is accomplished by assigning each player a set of chips having a unique color.

Returning to FIG. 2, the three betting areas 28, 30 and 32 correspond to the three possible number groupings which can be rolled on the die 34. The method of play of the game begins at this betting area. Any number of the maximum number of twelve players standing or sitting on the players side 12 may place betting chips in the three betting areas 28, 30 and 32. Dealer One places three cards face down on the designated marking spaces 36 (See FIG. 1). The Dealers then solicit the players to make their opening wager in the "First Chance Dice" area. Appropriate quantities and dollar value amounts of chips are placed on the betting areas 28, 30 and 32. Players can toss their chips to the dealers to be placed on the die combination of their choice if they are too far from the center game area 16. The first phase of the game thus consists of players betting on one roll of the die 34. The wager is to see which of the six sides of the die 34 will land facing up.

At the same time that bets are placed on the center game area 16 for the "First Chance Dice", players are also solicited to place their bets on the second phase game areas 18. As will be explained, players can place their bets on as many numbers or combinations of numbers as they choose. After an appropriate period of time as determined by the dealers, a dealer announces that no more bets can be placed on the first 24 or second 18 phase game areas. This is typically announced by stating "All bets in. No more bets."

The (NO ELEVEN) die 34 is placed in a cup holder (not shown) where the die is shaken and tossed onto the playing surface by a player desiring to roll. If the die 34 lands, for example, face up showing a (2 and 3) number grouping as shown in FIGS. 3E and 3F, all losing bets on game areas 28 and 30 are collected by the dealers, and the winning bets on game area 32 are then paid by the dealers. The payout by the house in the "First Chance Dice" areas are 1:1. In other words, an amount equal to the amount bet is added to the original bet, effectively doubling the players money. Table 1 below summarizes the odds of winning in the "First Chance Dice" game area 16.

TABLE 1

| | |
|---|---|
| Number of groupings and sides: | 2 sides of (1 and 2)<br>2 sides of (1 and 3)<br>2 sides of (2 and 3) |
| Number of sides: Number of times that each grouping appears on the die | 6:2 |
| Odds of rolling any particular group | 3:1 |

As shown, the odds of a player winning when assuming that a player puts chips on only one of the betting areas 28, 30 and 32, are 3:1 or approximately 33%. The reason for a payout of 1:1 is to be explained when looking at the payout for the second game phase 18.

After paying the winning bets and collecting the losing bets, the first phase of the game is concluded. Game play resumes by beginning the second phase of the game when a dealer turns over two of the three cards which were dealt face down at the beginning of the game. The cards which are turned over correspond to the two numbers which appeared face up on the die 34 in the first phase. Using again the example of having rolled a (2 and 3), the corresponding second and third cards in area 36 are overturned by a dealer. The dealers again collect the losing bets and pay the winning bets.

Figure 5:
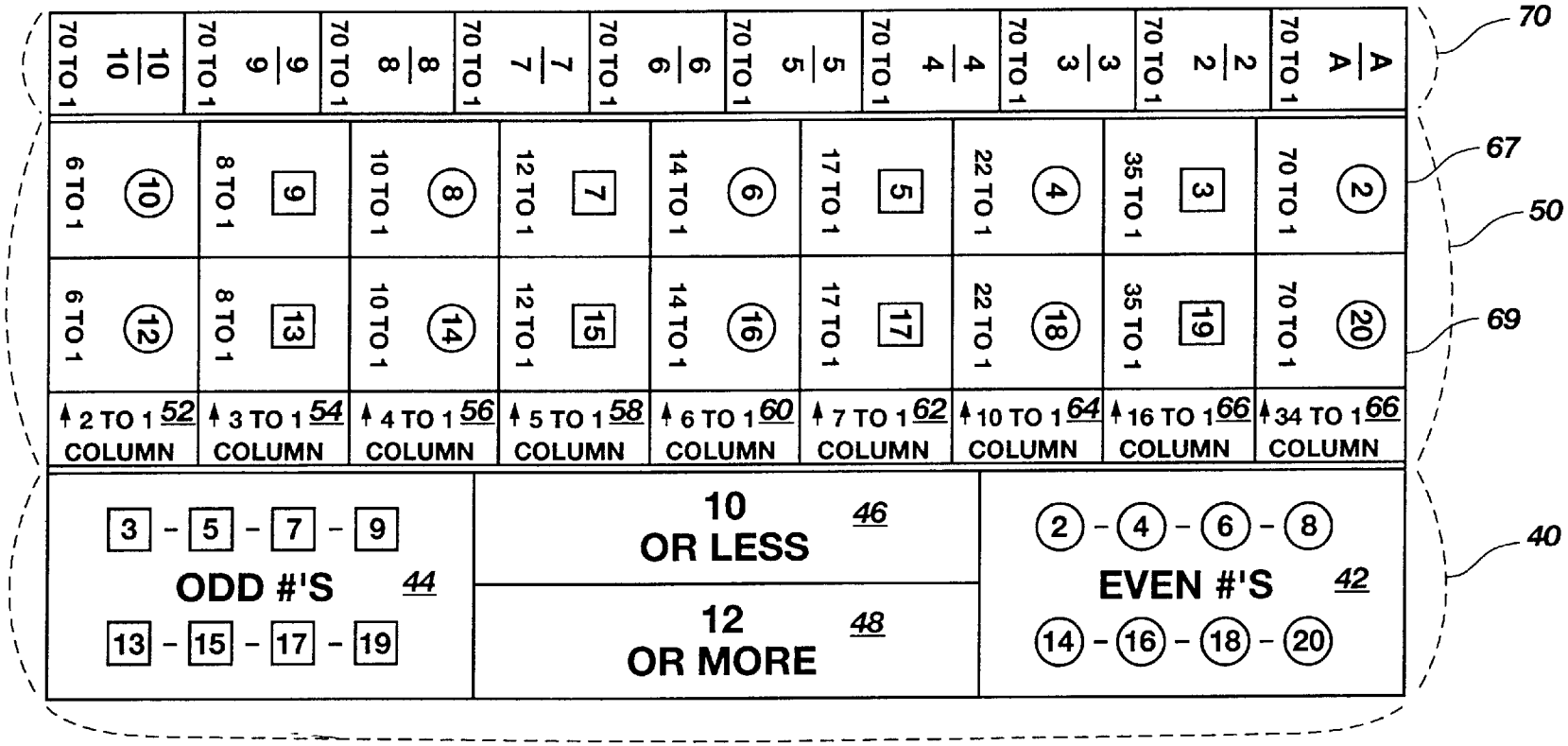
FIG. 5 is an enlarged top view of the game area used for the second phase which potentially has the largest payoff.

FIG. 5 shows an enlargement of one of the second phase game areas 18. The game layout is typical of casino gaming boards in that it is a betting area which has surprising order despite what may initially appear as a lack of structure. As will be explained, the game layout is actually conducive to organizing bets despite the large number of different wagers that a player can make. However, the various bets of widely varying payouts add to the excitement of the game. Furthermore, a somewhat complicated layout is in fact familiar to players.

The second phase game areas 18 are generally divided up into three different betting areas, defined by the degree of risk associated with the bet to be made. The first area 40 is an area of lowest risk betting. The first area 40 is actually further subdivided into areas defining four different wagers. The four areas are the "even" bet 42, the "odd" bet 44, the "10 or less" bet 46, and the "12 or more" bet 48. The first area 40 defines a strictly combination bet. In other words, the values of the two cards turned over summed to reach a total or combination. Determining which bets are winning is relatively straightforward at this point. If the sum of the two overturned cards is even, then all chips in the "even" area 42 area are winning bets and paid appropriately, except if the even number is a 10 or 12. The fact that the even numbers 10 and 12 are removed is explicitly stated on the betting area 42. The other betting areas 44, 46 and 48 are also just as self-explanatory as to when they contain winning bets and when they do not. It should be observed that in the "odd" betting area 44, the only odd number between 2 and 20 which is excluded is the number "11" which is always a losing combination in this game called (NO ELEVEN). (The number "1" of course can never be a combination of any two cards.)

An appropriate payout for this lowest risk betting area 40 is defined based upon the risk of the bet combined with an appropriate house advantage. Before determining that risk, it is useful to look at the possible card combinations. Table 2 summarizes all possible combinations of numbers which can result from the use of a single 20 card deck of (NO ELEVEN) cards.

TABLE 2

| NUMBER | POSSIBLE CARD COMBINATIONS |
|---|---|
| 2 | A:A |
| 3 | A:2/2:A |
| 4 | A:3/3:A/2.2 |
| 5 | A:4/4:A/2:3/3:2 |
| 6 | A:5/5:A/2:4/4:2/3:3 |
| 7 | A:6/6:A/2:5/5:2/3:4/4:3 |
| 8 | A:7/7:A/2:6/6:2/3:5/5:3/4:4 |
| 9 | A:8/8:A/2:7/7:2/3:6/6:3/4:5/5:4 |
| 10 | A:9/9:A/2:8/8:2/3:7/7:3/4:6/6:4/5:5 |
| 11 | A:10/10:A/2:9/9:2/3:8/8:3/4:7/7:4/5:6/6:5 |
| 12 | 10:2/2:10/9:3/3:9/8:4/4:8/7:5/5:7/6:6 |
| 13 | 10:3/3:10/9:4/4:9/8:5/5:8/7:6/6:7 |
| 14 | 10:4/4:10/9:5/5:9/8:6/6:8/7:7 |
| 15 | 10:5/5:10/9:6/6:9/8:7/7:8 |
| 16 | 10:6/6:10/9:7/7:9/8:8 |
| 17 | 10:7/7:10/9:8/8:9 |
| 18 | 10:8/8:10/9:9 |
| 19 | 10:9/9:10 |
| 20 | 10:10 |

Table 2 thus shows that there are a total of 100 card combinations the (NO ELEVEN) deck of cards. It should be noted that there a total of 50 even numbered card combinations, 50 odd numbered combinations, 10 even numbers and 9 odd numbers (excluding the number "11" when the house always wins.

Table 3 summarizes the results for the first betting area 40, including the payouts for winning bets.

TABLE 3

| | | |
|---|---|---|
| EVEN NUMBERS (2,4,6,8,14,16,18,20) | 32 ways to make these numbers, 68 ways not to | 100:32 or 3.13:1 to make 68:32 or 2.13:1 not to make |
| ODD NUMBERS (3,5,7,9,13,15,17,19) | 40 ways to make these numbers, 60 ways not to | 100:40 or 2.5:1 to make 60:40 or 1.5:1 not to make |
| 12 OR MORE 10 OR LESS | 45 ways to make these numbers, 55 ways not to | 100:45 or 2.22:1 to make 55:45 or 1.22:1 not to make |

These odds all show that a player is less likely to win than to lose. For example, the odds of a player correctly choosing that the combination of cards will be odd is 40%, and consequently the odds that the player will lose (and the house win) are 60%. From these odds, a determination must still be made as to what the house payout will be for a winning bet. For example, to determine the house payout for a player who bets and wins on an "even" bet, the following summary is provided. A particular percentage for the house advantage is selected. For the case of an even bet, a house advantage of 20 is selected. This house advantage is multiplied separately by the odds of winning and the odds of losing a particular bet to obtain subtracting amounts. These subtracting amounts are then separately subtracted from the odds of winning and losing.

EVENs

20% of 3.13 (odds of winning) is 0.63. 20% of 2.13 is 0.43.

| | | |
|---|---|---|
| Odds | 3.13 | 2.13 |
| 20% house advantage | ×0.63 | ×0.43 |
| | 2.50 | 1.70 |

From these results, the house payout is then 1:1, words other words pays an amount equal to the bet if the bet wins. Table 4 provides the results in the preferred embodiment for all of the betting which can occur during any phase of the game.

TABLE 4

| EVENT | AMOUNT BET ($) | AMOUNT WON ($) | PROB. OF PLAYER LOSING | PROB. OF PLAYER WINNING | HOUSE ADVANTAGE (%) |
|---|---|---|---|---|---|
| PLAYER USING NO STRATEGY | | | | | |
| 2 or 20 | 1 | 70 | 0.99 | 0.01 | 29 |
| 3 or 19 | 1 | 35 | 0.98 | 0.02 | 28 |
| 4 or 18 | 1 | 22 | 0.97 | 0.03 | 31 |
| 5 or 17 | 1 | 17 | 0.96 | 0.04 | 28 |
| 6 or 16 | 1 | 14 | 0.95 | 0.05 | 25 |
| 7 or 15 | 1 | 12 | 0.94 | 0.06 | 22 |
| 8 or 14 | 1 | 10 | 0.93 | 0.07 | 23 |
| 9 or 13 | 1 | 8 | 0.92 | 0.08 | 28 |
| 10 or 12 | 1 | 6 | 0.91 | 0.09 | 37 |
| <=10 or >=12 | 1 | 1 | 0.55 | 0.45 | 10 |
| EVEN | 1 | 1 | 0.68 | 0.32 | 36 |
| ODD | 1 | 1 | 0.6 | 0.4 | 20 |
| A/A ... 10/10 | 1 | 70 | 0.99 | 0.01 | 29 |
| COLUMNS 2, 20 | 1 | 34 | 0.98 | 0.02 | 30 |
| COLUMNS 3, 19 | 1 | 16 | 0.96 | 0.04 | 32 |
| COLUMNS 4, 18 | 1 | 10 | 0.94 | 0.06 | 34 |
| COLUMNS 5, 17 | 1 | 7 | 0.92 | 0.08 | 36 |
| COLUMNS 6, 16 | 1 | 6 | 0.9 | 0.01 | 30 |
| COLUMNS 7, 15 | 1 | 5 | 0.88 | 0.12 | 28 |
| COLUMNS 8, 14 | 1 | 4 | 0.86 | 0.14 | 30 |
| COLUMNS 9, 13 | 1 | 3 | 0.84 | 0.16 | 36 |
| COLUMNS 10, 12 | 1 | 2 | 0.82 | 0.18 | 46 |
| 1st CHANCE DICE | 1 | 1 | 0.67 | 0.33 | 34 |
| LAST CHANCE CARD | | | | | |
| STRAIGHT UP | 1 | 6 | 0.9 | 0.1 | 30 |
| COMBO | 1 | 2 | 0.8 | 0.2 | 40 |
| PLAYER BETTING ON MOST PROBABLE OUTCOME | | | | | |
| LAST CHANCE CARD | | | | | |
| STRAIGHT UP | 1 | 6 | 0.89 | 0.11 | 23 |
| COMBO | 1 | 2 | 0.78 | 0.22 | 34 |

The second betting area 50 provides several different betting strategies which the player can take advantage of. The second betting area 50 is also based on card combinations. However, a player can now bet on individual number combinations as defined by rows 67 and 69. The payout for making any of these card combinations is shown beneath each number in the rows. As should be obvious, the more difficult the card combination, the higher the payout. This is shown, for example, by observing that a sum of "2" in a card combination pays 70:1. This is because there is only 1 combination of cards whose sum is equal to "2". In contrast, the card combination of "10" can be obtained nine different ways as stated in Table 1. Therefore, the payout for a house advantage of 35% is 6:1.

The alternative method of betting in the second area 50 is to select two of the numbers which have the same odds of being turned up as defined in columns 52, 54, 56, 58, 60, 62, 64, 66, 68. For example, column 52 will pay 2:1 if either card combination totaling 10 or 12 turns up. The payout increases as the difficulty of making either number in the columns increases. A rule of thumb is that the payout is generally just below half of the payout for betting on either of the numbers in the columns.

A final betting area 70 is also shown in FIG. 5. This row is a very high risk betting area, but which has an appropriately large winning payout potential. A winning bet placed on this row 70 must have two identical cards overturned. The odds against any of these combinations as shown in TABLE 2 is 100:1. The payout is fixed at 70:1 assuming a house advantage of 30%.

Returning to FIG. 2 shows that the final third betting phase 26 is based upon a "Last Chance Card." The last card refers to the remaining card which is still lying face down in area 36 of the game surface 10. The betting moves back to the center game area 16 where there are two identical columns 80 labelled "Combo", and a single center column 82 labelled "Straight Up".

Dealers solicit bets for the third phase after payment of winning bets and collection of losing bets in the second game phase. After bets are made, a dealer reveals the value of the third card, and winning bets are paid. The dealers whose deck was not being used can then quickly assume the role of the primary dealer and start the game process almost immediately. In this way, a quick pace of the game is maintained be limiting the time between hands. It should be noted that the (SHUFFLEMASTER) card shuffling system can be employed so that the secondary dealer can quickly begin to assist the primary dealer in collecting and paying out the bets.

The method of play of the third phase 26 of the game is to wager on the value of the third card. However, the bet can be made on a single card, or a bet can be made to pick a combination of numbers, either one of which being turned over results in a winning bet. The payout for these bets are 6:1 and 2:1 respectively, based on the house odds selected and the odds of winning as determined by TABLES 2 and 4.

It should be obvious that if the two original cards turned over are the same card, such as both being "2", then there is no chance of another "2" being turned over.

A last consideration in the "Last Chance Card" bet is that there is a "No Strategy Play" and a "Most Probable Outcome Play".

These odds are included in TABLE 4. An explanation of the difference between these two strategies is as follows. A "No Strategy Play" is simply a bet made on the value of the last card to be turned over, regardless of the other cards. In other words, the bet is often referred to as a "straight up" bet where the player tries to guess the face value of the card. In contrast, the "Most Probable Outcome Play" refers to betting on which group of numbers the face value of the card will be found. There is a slight amount of strategy involved here in that the player knows the value of two of the cards which are no longer in the deck. If the values of the cards showing are both in the upper or lower half of the deck, the odds favor the value of the card to be turned over as being in the lower or upper half of the deck, respectively. However, the odds are even that the value of the card is in the lower or upper half if the values of the two overturned cards are split between the lower and upper halves.

The detailed description above is devoted to explaining the preferred embodiment of the game (NO-ELEVEN). However, it should be remembered that there are numerous modifications of the basic game design which can be implemented within the spirit and scope of the claims. For example, in an alternative embodiment shown in FIG. 6, the game (NO-ELEVEN) is played on a smaller game surface 90, and is referred to as (MINI NO-ELEVEN). Those skilled in the art will recognize that the shape of the game surface 90 and placement of chairs 92 is identical to that of other casino games of chance such as twenty one. The advantage of this layout is that the same tables already in use at a casino can be used without modification. The (MINI NO-ELEVEN) game surface 90 is just conveniently placed over the existing game on a table.

Figure 6:
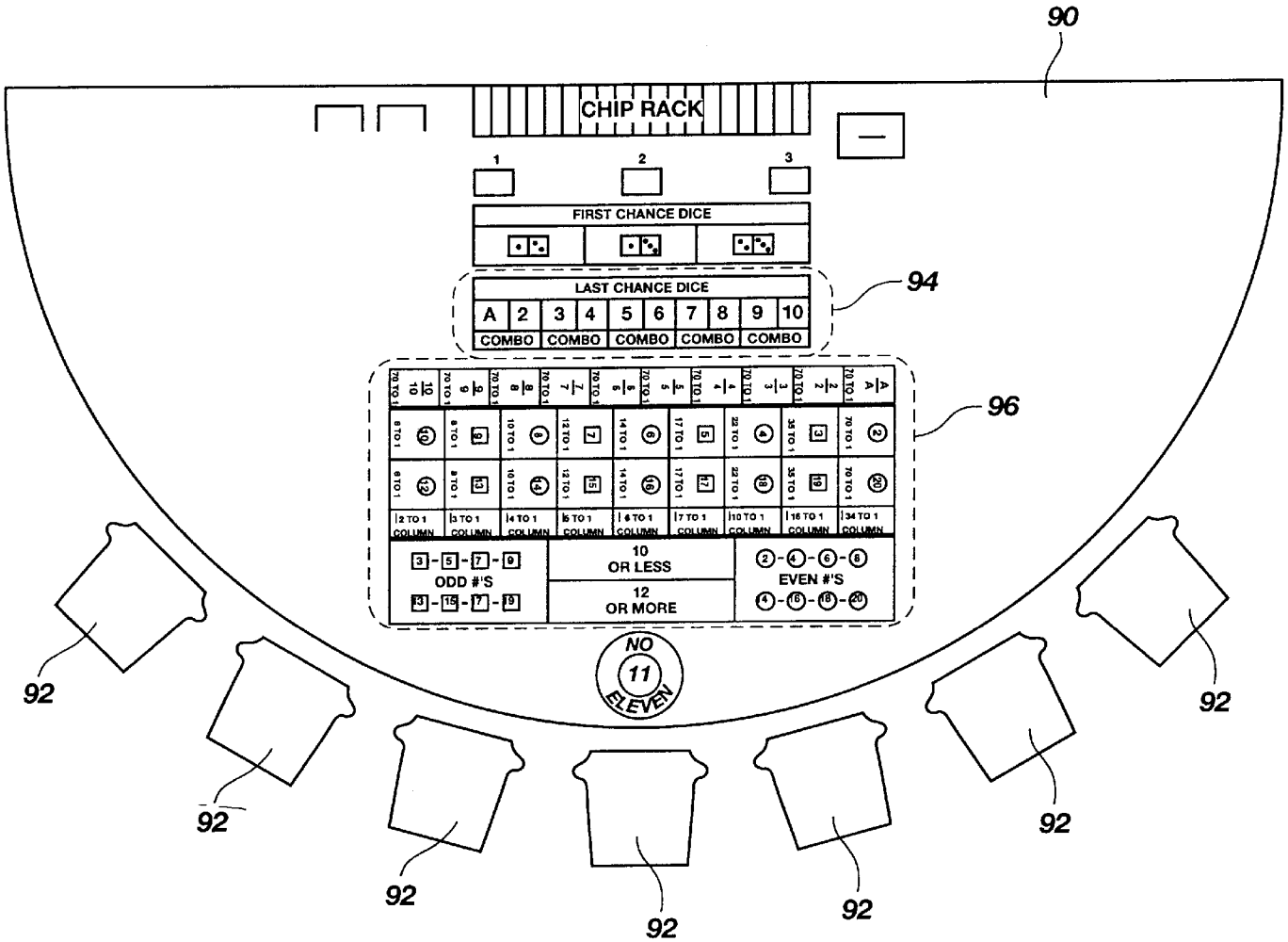
FIG. 6 is a top view of the complete board layout for a game of chance made in accordance with the principles of an alternative embodiment of the present invention.

FIG. 6 also shows that the actual game layout differs slightly from the layout shown in FIG. 1. However, the changes are merely cosmetic. The center gaming area 16 of FIG. 1 is now shown in FIG. 6 with the "Last Chance Card" area 26 being arranged horizontally in area 94 instead of vertically. In addition, only one second phase game area 18 is now shown in area 96. This is a natural consequence of the number of players at the table being reduced and therefore being able to reach the area 96 more easily. Otherwise, the method of play is exactly as described previously for (NO-ELEVEN), except that there is only one dealer for (MINI NO-ELEVEN) instead of the optional two.

Figure 7:
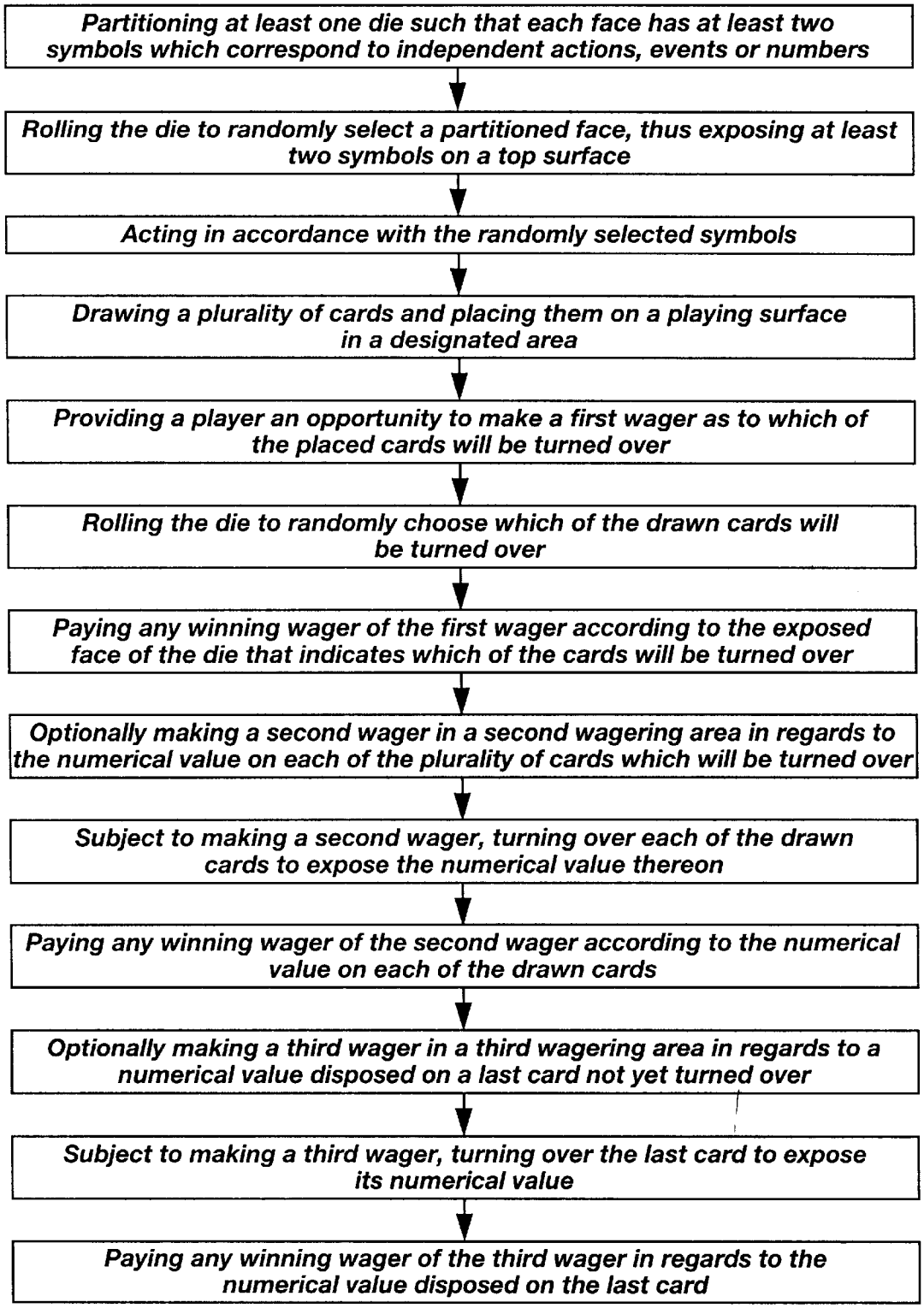
FIG. 7 is a flow chart showing the steps that correspond to the method of playing the game, according to the present invention.

FIG. 7 shows the specific method of plying the game, according to the present invention. A player may follow the steps of the game, as indicated by the flow chart, in a suquential manner and progresses through the various phases of the game.

A last topic which bears further explanation is the die 34 which was previously described in FIGS. 3A–F. The die 34 is a game piece used in the game of (NO-ELEVEN), in conjunction with the board, cards, tumbler and betting chips. However, the die 34 itself is an innovative part of the game. Typically, a die performs the function of providing a singular result or choice. That is, a die provides a singularly random result based upon which face of the die presents itself at a top surface after being rolled. The result is defined as a single symbol which is read from the die. Often, the symbol is a unique number which is then utilized under the particular rules of the game. Therefore, the function of the die is that it be rolled. When it is rolled, it is also assumed that it is balanced such that any face of the die is just as likely to appear at the top surface, when the die has finished rolling, as any other face.

The present invention, however, provides a die 34 which is segmented or partitioned on each face. Specifically, each face of the die 34 is divided into two partitions, each partition containing within it a symbol. In the preferred embodiment, it is the case that each of the symbols on any partitioned face are different from each other. Nevertheless, it is envisioned that the symbols could be the same symbol repeated on a single face. It is further the case that the symbols can operate independently of each other, or operate together.

It is another aspect of the invention that while the die 34 in the preferred embodiment uses the numerical symbols of dots to represent numbers which are common to dice, this should not be considered limiting. For example, the symbols could be colors or pictures which represent independent events, tasks, etc. What is important is that at least two independent results are described simultaneously by each face of the die 34.

For example, consider the case where a player is moving a game piece or token along a path. While it is typical to always move a token in one direction, the die 34 of the present invention could be used to offer a choice. The token might be moved forward a certain number of spaces as defined by one partition on a top surface of the die, or the token might also be moved backward a certain number of spaces as defined by the other partition on the top surface. The choice would depend on the most favorable outcome defined by the new spaces on which the token might now come to rest. This example should serve to indicate that the purposes for which the die described above can be used are many when a partitioned die can simultaneously provide more than one randomly arrived at result. The possible applications for games in general, and not just for gambling.

It is to be understood that the above-described embodiments are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A method for playing a game of chance wherein the game includes a playing surface having at least one wagering area, a single die for rolling, and a deck of cards, the method comprising the steps of:

a) drawing a plurality of cards from the deck of cards and placing the plurality of drawn cards face down on the playing surface, each being placed in one of a plurality of designated b) providing a player an opportunity to make at least one first wager in a first wagering area as to which of the plurality of drawn cards will be turned over;

c) partitioning a die such that each face thereof has at least two independent symbols which correspond to at least two of the designated areas;

d) rolling the single die to randomly choose which of the plurality of drawn cards will be turned over by exposing a face of the die;

e) paying any winning wager of the at least one first wager according to the exposed face of the die which indicates which of the plurality of drawn cards will be turned over;

f) optionally making at least one second wager in a second wagering area in regards to numerical values on each of the plurality of drawn cards which will be turned over;

g) subject to occurrence of step f), turning over each of the plurality of drawn cards to expose the numerical value disposed thereon as selected in step c);

h) subject to occurrence of step f), paying any winning wager of the at least one second wager according to the numerical value disposed on each of the plurality of drawn cards;

i) optionally making at least one third wager in a third wagering area in regards to a numerical value disposed on a last card not yet turned over in step g);

j) subject to occurrence of step i) turning over the last card to expose the numerical value; and k) subject to occurrence of step i), paying any winning wager of the at least one third wager in regards to the numerical value disposed on the last card.

2. The method as defined in claim 1 wherein the method includes the additional steps of:

a) shuffling the deck of cards; and b) repeating the method of claim 1.

3. The method as defined in claim 1 wherein the method includes the more specific step of selecting a deck of cards having ten numbers, and wherein each card is duplicated to create ten pairs of cards.

4. The method as defined in claim 3 wherein the method includes the more specific step of selecting a sequence of numbered cards which begin with an ace and end with a ten.

5. The method as defined in claim 1 wherein the method includes the more specific step of providing three designated areas numbered one, two and three.

6. The method as defined in claim 5 wherein the method includes the more specific step of providing a die having pairs of numbers on each face thereof, and wherein each pair of numbers is duplicated to create two sets of three pairs of numbers.

7. The method as defined in claim 6 wherein the method includes the more specific step of selecting as the three pairs of the pairs of one and two, one and three, and two and three.

8. The method as defined in claim 1 wherein the step of providing a player an opportunity to make at least one first wager includes the more specific steps of:

a) dividing the first wagering area into three partitions, wherein each of the three partitions corresponds to one of the three designated areas;

b) placing at least one betting chip on at least one of the three partitions selected as corresponding to one of the three drawn cards which will be turned over last; and c) paying as a winning wager any player whose at least one betting chip was placed in the partition corresponding to the last card.

9. The method as defined in claim 1 wherein the step of optionally making at least one second wager with regard to a numerical value disposed on each of the plurality of drawn cards which will be turned over includes the more specific step of making the at least one second wager with respect to the numerical value being a number whose sum is less than ten.

10. The method as defined in claim 9 wherein the method comprises the more specific step of optionally making the at least one second wager with regard to the numerical value being a number whose sum is greater than twelve.

11. The method as defined in claim 10 wherein the method comprises the more specific step of optionally making the at least one second wager with regard to the numerical value being a number whose sum is one of a group of even numbers.

12. The method as defined in claim 11 wherein the method comprises the more specific step of optionally making the at least one second wager with regard to the numerical value being a number whose sum is one of a group of odd numbers.

13. The method as defined in claim 12 wherein the method comprises the more specific step of optionally making the at least one second wager with regard to the numerical value being a number whose sum is a specific number between two and twenty.

14. The method as defined in claim 13 wherein the method comprises the more specific step of optionally making the at least one second wager with regard to the numerical value being a sum which is one of two numbers between two and twenty.

15. The method as defined in claim 14 wherein the method comprises the more specific step of optionally making the at least one second wager with regard to the numerical value being a number on a pair of cards which are identical.

16. The method as defined in claim 1 wherein the step of optionally making at least one third wager in regards to the numerical value on a last card not yet turned over comprises the more specific step of optionally making the at least one third wager with regard to a face value of a number being the symbol on the last card.

17. The method as defined in claim 16 wherein the method comprises the more specific step of making the at least one third wager with regard to the at least one characteristic of having a face value being one of two numbers within a group, and wherein there are five groups of two numbers each.

18. A method for playing a game having at least one die for rolling, a playing surface having at least one wagering area, and a deck of cards, the method comprising the steps of:

a) partitioning the at least one die such that each face thereof has at least two symbols which correspond to independent actions, events or numbers;

b) rolling the at least one die to randomly select a partitioned face thereof, thereby exposing at least two symbols on a top surface thereof;

c) acting in accordance with the randomly selected symbols;

d) drawing a plurality of cards from the deck of cards and placing the plurality of drawn cards face down on the playing surface, each being placed in one of a plurality of designated areas;

e) providing a player an opportunity to make at least one first wager in a first wagering area as to which of the plurality of drawn cards will be turned over, f) rolling the die to randomly choose which of the plurality of drawn cards will be turned over by exposing a face of the die;

g) paying any winning wager of the at least one first wager according to the exposed face of the die which indicates which of the plurality of drawn cards will be turned over;

h) optionally making at least one second wager in a second wagering area in regards to a numerical value on each of the plurality of drawn cards which will be turned over, i) subject to occurrence of step h), turning over each of the plurality of drawn cards to expose the numerical value disposed thereon as selected in step f);

i) subject to occurrence of step h), paying any winning wager of the at least one second wager according to the numerical value on each of the plurality of drawn cards;

k) optionally making at least one third wager in a third wagering area in regards to a numerical value disposed on a last card not yet turned over in step i);

l) subject to occurrence of step k), turning over the last card to expose the numerical m) subject to occurrence of step k), paving any winning wager of the at least one third wager in regards to the numerical value disposed on the last card.

19. The method as defined in claim 18 wherein the method includes the additional steps of:

a) shuffling the deck of cards; and b) repeating the method of claim 18.

* * * * *